US009131748B2

(12) United States Patent
James

(10) Patent No.: US 9,131,748 B2
(45) Date of Patent: Sep. 15, 2015

(54) SOLE ASSEMBLY WITH GAS AND VISCOUS FLUID-FILLED BLADDER ASSEMBLY

(75) Inventor: Dervin James, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 381 days.

(21) Appl. No.: 13/454,688

(22) Filed: Apr. 24, 2012

(65) Prior Publication Data

US 2013/0276329 A1 Oct. 24, 2013

(51) Int. Cl.

| | |
|---|---|
| ***A43B 7/06*** | (2006.01) |
| ***A43B 13/18*** | (2006.01) |
| ***A43B 17/02*** | (2006.01) |
| *A43B 13/20* | (2006.01) |

(52) U.S. Cl.

CPC ..... *A43B 13/189* (2013.01); *A43B 17/026* (2013.01); *A43B 13/20* (2013.01)

(58) Field of Classification Search

CPC ..... A43B 7/06; A43B 7/081; A43B 7/08; A43B 7/14; A43B 7/28; A43B 13/20; A43B 13/206; A43B 5/0405; A43B 17/03; A43B 17/026

See application file for complete search history.

(56) References Cited

U.S. PATENT DOCUMENTS

| | | | | |
|---|---|---|---|---|
| 2,097,607 | A | | 11/1937 | Spira |
| 4,008,530 | A | | 2/1977 | Gager |
| 4,342,157 | A | | 8/1982 | Gilbert |
| 4,768,295 | A | | 9/1988 | Ito |
| 4,864,737 | A | | 9/1989 | Marrello |
| 4,906,502 | A | | 3/1990 | Rudy |
| 4,934,072 | A | | 6/1990 | Fredericksen et al. |
| 5,010,662 | A | | 4/1991 | Dabuzhsky et al. |
| 5,083,361 | A | * | 1/1992 | Rudy ..... 29/454 |
| 5,097,607 | A | | 3/1992 | Fredericksen |
| 5,363,570 | A | * | 11/1994 | Allen et al. ..... 36/28 |
| 5,406,719 | A | | 4/1995 | Potter |
| 5,493,792 | A | | 2/1996 | Bates et al. |
| 5,543,194 | A | * | 8/1996 | Rudy ..... 428/69 |
| 5,564,202 | A | | 10/1996 | Hoppenstein |
| 5,718,063 | A | | 2/1998 | Yamashita et al. |
| 5,741,568 | A | | 4/1998 | Rudy |
| 5,771,606 | A | | 6/1998 | Litchfield et al. |
| 5,813,142 | A | | 9/1998 | Demon |
| 5,930,918 | A | | 8/1999 | Healy et al. |
| 5,987,779 | A | | 11/1999 | Litchfield et al. |
| 5,987,781 | A | * | 11/1999 | Pavesi et al. ..... 36/29 |
| 5,993,585 | A | | 11/1999 | Goodwin et al. |
| 6,115,944 | A | | 9/2000 | Lain |
| 6,119,371 | A | * | 9/2000 | Goodwin et al. ..... 36/29 |
| 6,158,149 | A | | 12/2000 | Rudy |
| 6,176,025 | B1 | * | 1/2001 | Patterson et al. ..... 36/28 |
| 6,306,112 | B2 | | 10/2001 | Bird |
| 6,405,456 | B1 | | 6/2002 | Nichelson |
| 6,412,194 | B1 | * | 7/2002 | Carlson et al. ..... 36/43 |

(Continued)

*Primary Examiner* — Khoa Huynh
*Assistant Examiner* — Megan Brandon
(74) *Attorney, Agent, or Firm* — Honigman Miller Schwartz and Cohn LLP; Matthew H. Szalach; Jonathan P. O'Brien

(57) ABSTRACT

A bladder assembly for an article of footwear includes a main body. The main body defines a first chamber and a second chamber, and the second chamber includes a first inner surface and a second inner surface. The bladder assembly also includes a viscous fluid contained in the first or second chamber and a gas contained in the other of the first or second chamber. Furthermore, the bladder assembly includes a fabric member that is fixed to both the first and second inner surfaces. The fabric member limits movement of the first and second inner surfaces away from each other.

20 Claims, 3 Drawing Sheets

(56) References Cited

U.S. PATENT DOCUMENTS

| | | | | |
|---|---|---|---|---|
| 6,457,263 | B1 | 10/2002 | Rudy | |
| 6,865,823 | B1 * | 3/2005 | Vindriis | 36/29 |
| 6,976,321 | B1 * | 12/2005 | Lakic | 36/29 |
| 7,020,988 | B1 | 4/2006 | Holden et al. | |
| 7,070,845 | B2 * | 7/2006 | Thomas et al. | 428/69 |
| 7,132,032 | B2 * | 11/2006 | Tawney et al. | 156/290 |
| 7,278,226 | B2 | 10/2007 | Holden et al. | |
| 7,386,946 | B2 * | 6/2008 | Goodwin | 36/29 |
| 7,451,556 | B2 * | 11/2008 | Harmon-Weiss et al. | 36/35 B |
| 2002/0035794 | A1 * | 3/2002 | Doyle | 36/29 |
| 2004/0086681 | A1 * | 5/2004 | Wang | 428/76 |
| 2005/0039346 | A1 * | 2/2005 | Thomas et al. | 36/29 |
| 2005/0167029 | A1 * | 8/2005 | Rapaport et al. | 156/145 |
| 2006/0032089 | A1 * | 2/2006 | Lo | 36/29 |
| 2006/0143943 | A1 * | 7/2006 | Cho et al. | 36/3 B |
| 2006/0277801 | A1 * | 12/2006 | Schwarze et al. | 36/141 |
| 2007/0056188 | A1 * | 3/2007 | Tsai | 36/29 |
| 2007/0063368 | A1 * | 3/2007 | Schindler | 264/45.1 |
| 2007/0169376 | A1 * | 7/2007 | Hatfield et al. | 36/29 |
| 2008/0066342 | A1 * | 3/2008 | Park | 36/29 |
| 2008/0066347 | A1 * | 3/2008 | Suzuki | 36/83 |
| 2009/0126226 | A1 * | 5/2009 | Morita et al. | 36/43 |
| 2009/0152774 | A1 * | 6/2009 | Hensley et al. | 264/524 |
| 2009/0203275 | A1 * | 8/2009 | Dehn | 442/1 |
| 2009/0288312 | A1 | 11/2009 | Dua | |
| 2009/0288313 | A1 * | 11/2009 | Rapaport et al. | 36/29 |
| 2010/0132221 | A1 * | 6/2010 | Swigart et al. | 36/27 |
| 2010/0205831 | A1 * | 8/2010 | Cheskin et al. | 36/44 |
| 2010/0212188 | A1 * | 8/2010 | Granger et al. | 36/44 |
| 2010/0306894 | A1 * | 12/2010 | Calvert | 2/16 |
| 2011/0277346 | A1 * | 11/2011 | Peyton et al. | 36/29 |
| 2011/0277347 | A1 * | 11/2011 | Monfils et al. | 36/29 |
| 2011/0277916 | A1 * | 11/2011 | Beye et al. | 156/145 |
| 2012/0023776 | A1 * | 2/2012 | Skaja et al. | 36/44 |
| 2012/0233879 | A1 * | 9/2012 | Dojan et al. | 36/29 |
| 2013/0239443 | A1 * | 9/2013 | Lin | 36/3 B |
| 2013/0266773 | A1 * | 10/2013 | Hazenberg et al. | 428/188 |

* cited by examiner

SOLE ASSEMBLY WITH GAS AND VISCOUS FLUID-FILLED BLADDER ASSEMBLY

FIELD

The present disclosure relates generally to a sole assembly and, more particularly, to a sole assembly with a gas and viscous fluid-filled bladder assembly.

BACKGROUND

This section provides background information related to the present disclosure which is not necessarily prior art.

Articles of footwear usually include an upper and a sole assembly. The upper can include sections of thin material, straps, laces, and the like for covering the wearer's foot and securing the footwear to the wearer. The sole assembly can include an outsole that is typically a unitary piece of relatively durable, high-friction material that provides traction for the footwear. Also, the sole assembly can include a midsole that resiliently deforms to provide cushioned support for the wearer.

In some cases, the midsole can include a single, unitary foam member that conforms to the curvatures of the foot and that resiliently deforms for cushioning the wearer. In other cases, the midsole can include one or more bladders that are fluid filled.

SUMMARY

This section provides a general summary of the disclosure, and is not a comprehensive disclosure of its full scope or all of its features.

A bladder assembly for an article of footwear is disclosed that includes a main body. The main body defines a first chamber and a second chamber, and the second chamber includes a first inner surface and a second inner surface. The bladder assembly also includes a viscous fluid contained in the first or second chamber and a gas contained in the other of the first or second chamber. Furthermore, the bladder assembly includes a fabric member that is fixed to both the first and second inner surfaces. The fabric member limits movement of the first and second inner surfaces away from each other.

Furthermore, an article of footwear is disclosed that includes an upper and a sole assembly that is operably coupled to the upper. The sole assembly includes a bladder assembly with a main body. The main body defines a first chamber and a second chamber, and the second chamber includes a first inner surface and a second inner surface. The bladder assembly also includes a viscous fluid contained in the first or second chamber and a gas contained in the other of the first or second chamber. Furthermore, the bladder assembly includes a fabric member that is fixed to both the first and second inner surfaces. The fabric member limits movement of the first and second inner surfaces away from each other.

Still further, an article of footwear is disclosed that includes an upper, an outsole, and a midsole assembly operably coupled to both the upper and the outsole. The midsole includes a bladder assembly, which includes a first sheet and a second sheet. The first and second sheets overlap each other and are sealed together at a substantially continuous peripheral seal to define a first chamber. The first and second sheets are additionally sealed at a plurality of internal seals surrounded by the peripheral seal to define a plurality of second chambers and a plurality of channels that fluidly connect respective ones of the second chambers. Furthermore, the footwear includes a viscous fluid contained within the first chamber. The viscous fluid includes gel and/or a flowable clay. The footwear additionally includes a gas contained within each of the plurality of second chambers and the plurality of channels. Moreover, the footwear includes a plurality of compressible fabric members, each contained within respective ones of the second chambers, and each including a first fabric layer and a second fabric layer and a plurality of connecting filaments extending between the first and second fabric layers. The first fabric layer is fixed to the first sheet, and the second fabric layer is fixed to the second sheet. The plurality of connecting filaments limit movement of the respective first and second fabric layers away from each other to maintain at least a portion of the respective second chamber substantially flat.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
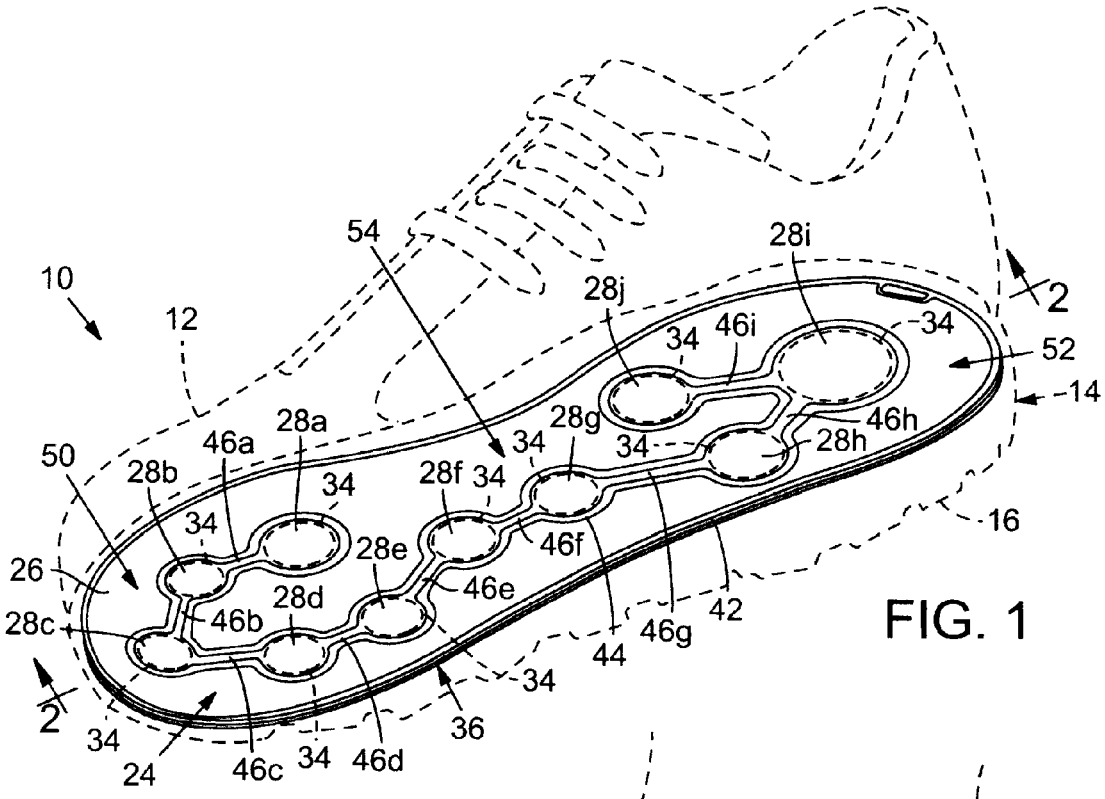
FIG. 1 is a perspective view of an article of footwear according to various exemplary embodiments of the present disclosure, wherein portions of the article of footwear are shown in phantom.
Figure 2:
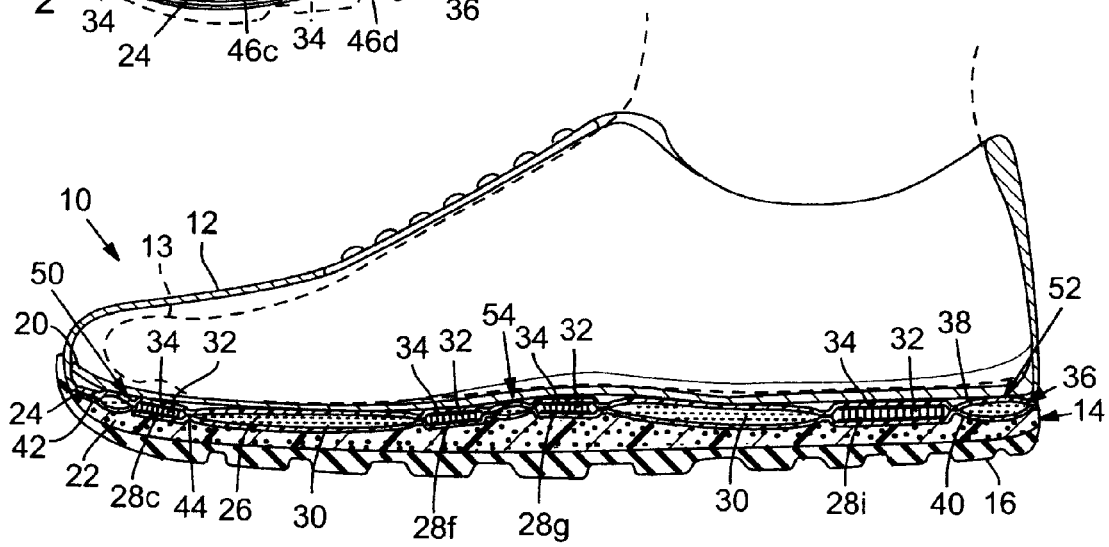
FIG. 2 is a cross sectional view of the article of footwear taken along the line 2-2 of FIG. 1.
Figure 3:
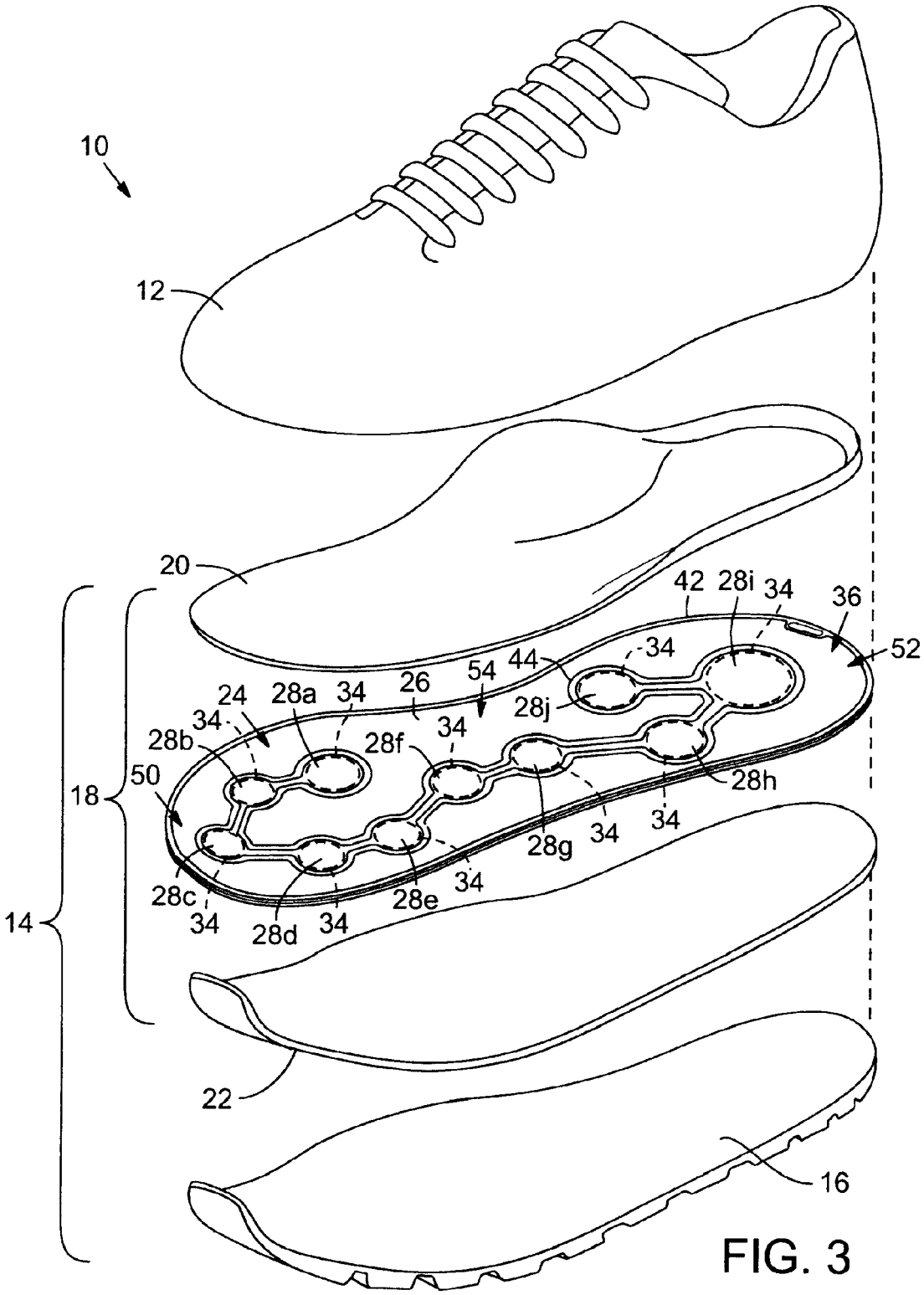
FIG. 3 is an exploded view of the article of footwear of FIG. 1.
Figure 4:
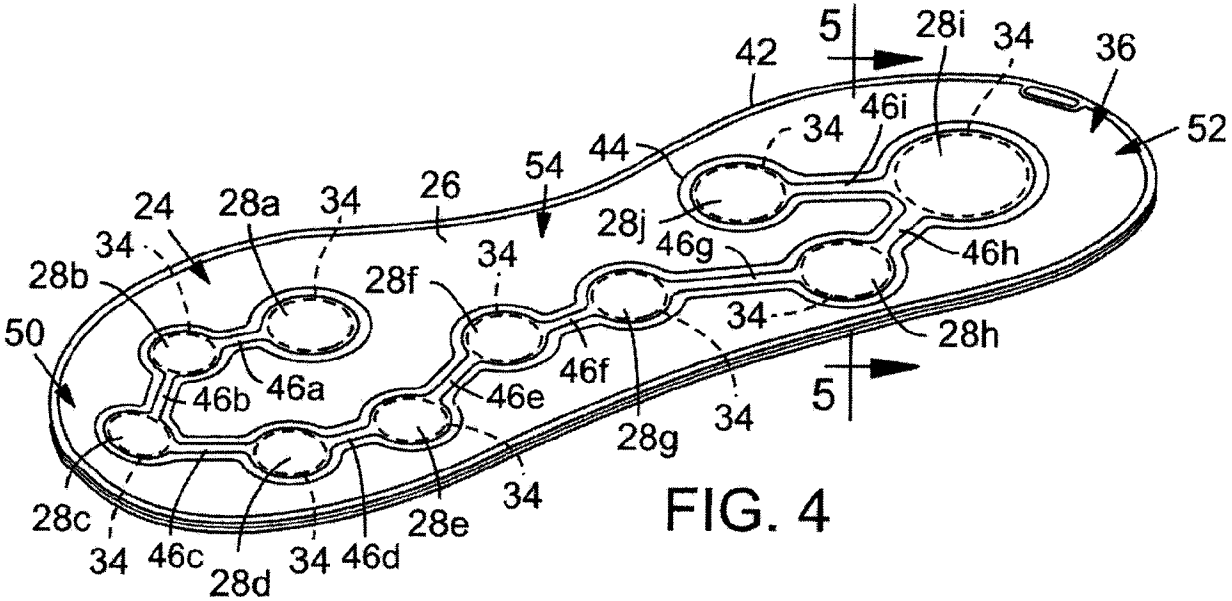
FIG. 4 is a perspective view of a bladder assembly of the article of footwear of FIG. 1.

Referring initially to FIGS. 1-3, an exemplary embodiment of an article of footwear 10 is illustrated according to various teachings of the present disclosure. Generally, the article of footwear 10 includes an upper 12 and a sole assembly 14. The sole assembly 14 is operatively coupled to the upper 12 and can include an outsole 16 and a midsole assembly 18. Although the article of footwear 10 is illustrated as an athletic shoe, it will be appreciated that the footwear 10 could be a boot, a sandal, or any other type without departing from the scope of the present disclosure.

In some embodiments, the upper 12 can include various thin sheets of material that partially overlap each other and that are operably secured to each other, for example, by stitching, adhesives, and the like. The upper 12 can also include a fastening structure, such as laces, buckles, pile tape, and/or other features for tightly securing the upper 12 to a wearer's foot 13 (shown in phantom in FIG. 2). It will also be appreciated that the upper 12 can include various decorative features for aesthetically enhancing the footwear 10.

Also, the outsole 16 can include a layer of high-friction material (e.g., rubber, etc.) for providing traction. Moreover, the midsole assembly 18 can be disposed between and operably coupled to both the outsole 16 and the upper 12. The midsole assembly 18 can provide cushioned support for the wearer's foot 13 as will be discussed in greater detail below.

As shown in FIG. 3, the midsole assembly 18 can include a first portion 20, a second portion 22, and a bladder assembly 24, which is disposed between the first and second portions 20, 22. The bladder assembly 24 can be overlapped on opposite sides by the first and second portions 20, 22. Also, in some embodiments, the bladder assembly 24 can be operably coupled to (e.g., fixed to) the first portion 20 and/or the second portion 22. For instance, the bladder assembly 24 can be embedded in the first portion 20 and/or the second portion 22, for instance, using a molding process, via adhesives, and the like. Also, in some embodiments, the bladder assembly 24 can be separate (i.e., unattached) from the first portion 20 and/or the second portion 22.

The first and second portions 20, 22 can be made of or include a layer of polymer (e.g., foam, etc.) that is resiliently flexible and resiliently compressible. The first and/or second portions 20, 22 can be contoured in a manner that conforms to the foot 13.

Figure 5:
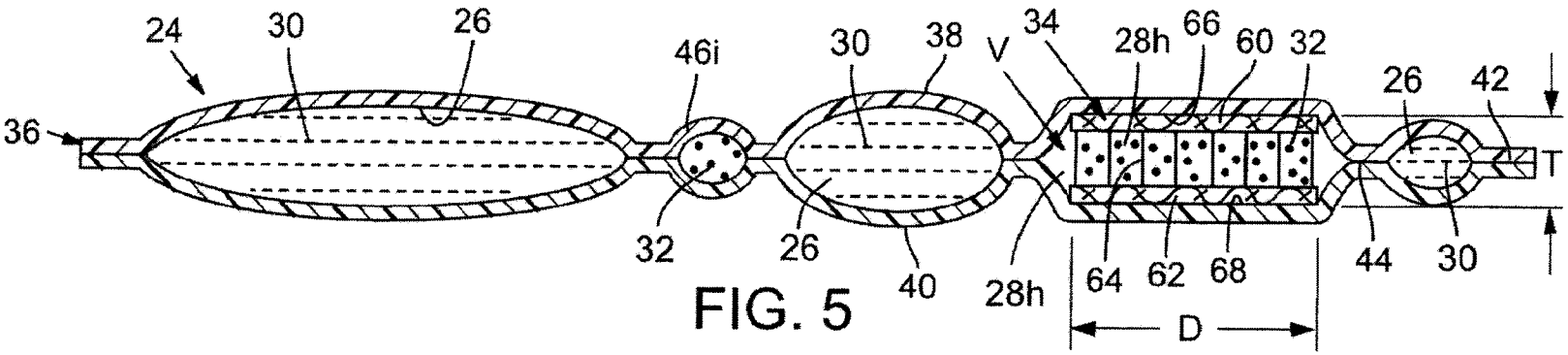
FIG. 5 is a sectional view of the bladder assembly taken along the line 5-5 of FIG. 4.

Also, the bladder assembly can define a first chamber 26 and one or more second chambers 28*a*-28*j*. The first chamber 26 can contain a viscous fluid 30, such as a gel or flowable clay. The second chambers 28*a*-28*j* can contain a gas 32, such as air. In additional embodiments, the first chamber 26 contains the gas 32 while the second chambers 28*a*-28*j* contain the fluid 30. Moreover, one or more fabric members 34 can be encapsulated within respective second chambers 28*a*-28*j*. In some embodiments, the fabric members 34 are cylindrically shaped with a diameter D and a thickness T that is less than the diameter D (FIG. 5). Accordingly, different portions of the bladder assembly 24 can provide different types and different levels of support of the wearer's foot 13 as will be discussed in greater detail below.

Referring now to FIGS. 1-5, the bladder assembly 24 will be discussed in greater detail. The bladder assembly 24 can include a main body 36 that defines the first and second chambers 26, 28*a*-28*j*. More specifically, the bladder assembly 24 can include a first sheet 38 and a second sheet 40 (see FIG. 2). The first and second sheets 38, 40 can each be made of or include a polymeric material. As shown in FIG. 2, the first and second sheets 38, 40 can overlap each other and can be coupled together at various locations to define the first and second chambers 26, 28*a*-28*j*. More specifically, the first and second sheets 38, 40 can be sealed or bonded together (e.g., hermetically sealed) by a known plastic welding process to define various seals 42, 44 or weldments. Also, in some embodiments, the first and second sheets 38, 40 can be joined and sealed together by other suitable means, such as adhesives.

In the embodiments shown in FIGS. 1-5, the first and second sheets 38, 40 can be sealed together at a peripheral seal 42. The peripheral seal 42 can extend continuously about the periphery of the main body 36 of the bladder assembly 24. Also, the first and second sheets 38, 40 can be sealed together at an internal seal 44. The internal seal 44 can extend continuously, and can be surrounded and spaced apart from the peripheral seal 42. Accordingly, the first chamber 26 can be defined between the peripheral seal 42 and the internal seal 44 (i.e., between the peripheral seal 42 and the second chambers 28*a*-28*j*).

The internal seal 44 can define the plurality of second chambers 28*a*-28*j*, which are substantially circular in some embodiments. The internal seal 44 can also define a plurality of channels 46*a*-46*i*, which are elongate and fluidly connected at both ends to respective pairs of second chambers 28*a*-28*j*. The channels 46*a*-46*i* can provide fluid communication between the plurality of second chambers 28*a*-28*j*.

It will be appreciated that the first chamber 26, the second chambers 28*a*-28*j*, and the channels 46*a*-46*i* can be disposed, positioned, and arranged in any suitable location in the article of footwear 10. Also, it will be appreciated that the bladder assembly 24 can include a plurality of first chambers 26. Moreover, it will be appreciated that the bladder assembly 24 can include any suitable number of second chambers 28*a*-28*j* and channels 46*a*-46*j*.

In the embodiments illustrated in FIGS. 1-5, the footwear 10 can include ten second chambers 28*a*-28*j* that are linked in a "chain" by respective channels 46*a*-46*j*. The "chain" of second chambers 28*a*-28*j* and channels 46*a*-46*j* can extend over a forefoot region 50 of the bladder assembly 24, across a midfoot region 54 of the bladder assembly 24, and over a rearfoot region 52 of the bladder assembly 24. More specifically, one end of the "chain" (i.e., the second chamber 28*a*) can be disposed in the forefoot region 50 to be disposed generally underneath the big toe of the foot 13. The "chain" can extend anteriorly toward the second chambers 28*c*. Then, the "chain" can extend posteriorly along the lateral side of the foot 13 to the rearfoot region 52 such that the second chamber 28*i* is disposed generally underneath the heel of the foot 13. Then, the "chain" can extend anteriorly and can end at the second chamber 28*j*.

The first chamber 26 can also extend across each of the forefoot, rearfoot, and midfoot regions 50, 52, 54. In the embodiments shown, the first chamber 26 is disposed primarily on the periphery and other areas that correspond to lower stress points of the foot 13.

As mentioned above, the first chamber 26 can contain a viscous fluid 30 (FIGS. 2 and 5). The viscous fluid 30 can be of any suitable type and can have any suitable viscosity. In some embodiments, the viscous fluid 30 can be a gel or a flowable clay. Accordingly, the fluid 30 can flow within the first chamber 26 to allow the first chamber 26 to deflect (e.g., due to compression loads from the foot 13). Thus, the first chamber 26 can closely conform to the shape of the foot and provide a high level of cushioned support.

Moreover, as mentioned above, the gas 32 can be contained in and can flow through the second chambers 28*a*-28*j* and the channels 46*a*-46*j*. The gas 32 can be of any suitable type (e.g., oxygen, nitrogen, helium, etc.). Also, the gas 32 can be at any suitable pressure.

In addition, as mentioned above, the second chambers 28*a*-28*j* can each encapsulate a respective fabric member 34. The fabric member 34 and/or the bladder assembly 24 can incorporate any of the features disclosed in U.S. Pat. No. 4,906,502, issued Mar. 6, 1990 to Rudy and U.S. Pat. No. 5,083,361, issued Jan. 28, 1992, to Rudy, which are hereby incorporated by reference in their entireties.

Thus, as shown in FIG. 5, each fabric member 34 can include a first fabric layer 60 and a second fabric layer 62. The first and second fabric layers 60, 62 can have any suitable shape. In some embodiments, the first and second fabric layers 60, 62 can be flat and rounded (e.g., substantially circular with a diameter D). Also, the fabric members 34 can each include a plurality of connecting filaments 64 that are connected to and that extend transversely between the respective first and second fabric layers 60, 62. The filaments 64 can be flexible, but non-elastic when in tension.

Moreover, the first fabric layer 60 can be operably coupled (e.g., fixed) to an inner surface 66 of the first sheet 38 of the bladder assembly 24 within the respective second chamber 28*a*-28*j*. Likewise, the second fabric layer 62 can be operably coupled (e.g., fixed) to an inner surface 68 of the second sheet 40 of the bladder assembly 24 within the respective second chamber 28*a*-28*j*. The first and second fabric layers 60, 62 can be coupled to the first and second sheets 38, 40, respectively, in any suitable manner, such as adhesives.

Accordingly, the gas 32 within the second chambers 28*a*-28*j* can inflate the second chambers 28*a*-28*j* and also place the filaments 64 in tension. The length of the filaments 64 can be such that the fabric member 34 can have a thickness T (FIG. 5). In some embodiments, each fabric members 34 can occupy the majority of the volume V of the respective second chamber 28*a*-28*j*. More specifically, the peripheral volume of each fabric member 34 (peripheral volume=$\pi(D/2)^2$ (T)) occupies a majority of the volume V of the respective second chamber 28*a*-28*j*.

Thus, because the first and second fabric layers 60, 62 are operably coupled to the first and second sheets 38, 40, respectively, the filaments 64 can limit movement of the first and second fabric layers 60, 62 (and, thus, the first and second sheets 38, 40) away from each other. More specifically, when the second chambers 28*a*-28*j* are subject to a compressive load, the second chamber 28*a*-28*j* can compress and reduce the thickness T of the respective fabric member 34. In some embodiments, the filaments 64 do not resist this compression. The second chambers 28*a*-28*j* can resiliently recover such that the fabric member 34 regains its total thickness T, limited by the length of the filaments 64. As shown in FIG. 5, the fabric member 34 can maintain at least a portion of the respective second chamber 28*a*-28*j* in a substantially flat state. More specifically, as shown in FIG. 5, the first sheet 38 and the second sheet 40 of the second chamber 28*h* can be substantially flat. This feature can improve the fit and feel of the footwear 10 and the second chambers 28*a*-28*j* can better support the foot 13.

In some embodiments, the second chambers 28*a*-28*j* can be pressurized such that the second chambers 28*a*-28*j* are more stiff (e.g., more resistant to compressive deformation) than the first chamber 26. As mentioned above, the second chambers 28*a*-28*j* can be positioned in areas corresponding to higher-stress portions of the foot 13 as compared to the first chamber 26. Thus, the second chambers 28*a*-28*j* can support these higher-stress areas and provide resiliency, whereas the first chamber 26 can readily deform to conform to the lower-stress areas of the foot 13. Accordingly, the bladder assembly 24 can provide a high degree of comfort and cushioned support for the wearer, across a wide range of activities.

The foregoing description of the embodiments has been provided for purposes of illustration and description. It is not intended to be exhaustive or to limit the present disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the present disclosure, and all such modifications are intended to be included within the scope of the present disclosure.

What is claimed is:

1. A bladder assembly for an article of footwear comprising:

a main body that defines a first chamber, a second chamber, and an internal seal that separates the first and second chambers, the internal seal preventing fluid flow between the first and second chambers, the second chamber including a first inner surface and a second inner surface;

a viscous fluid contained in one of the first chamber and the second chamber;

a gas contained in the other of the first chamber and the second chamber; and a fabric member that is fixed to both the first and second inner surfaces, the fabric member limiting movement of the first and second inner surfaces away from each other;

wherein the main body includes a first sheet and a second sheet, the first and second sheets overlapping each other, wherein the first and second sheets are directly attached at a peripheral seal;

wherein the peripheral seal extends continuously about the entire main body;

wherein the first and second sheets are directly attached at the internal seal;

wherein the internal seal extends continuously along the main body;

wherein the internal seal is surrounded by the peripheral seal;

wherein the internal seal is spaced apart from the peripheral seal;

wherein the first sheet, the second sheet, the peripheral seal, and the internal seal cooperate to define the first chamber; and wherein the first sheet, the second sheet, and the internal seal cooperate to define the second chamber.

2. The bladder assembly of claim 1, wherein the main body defines a plurality of second chambers, and wherein the main body further defines a channel that provides fluid communication between the plurality of second chambers.

3. The bladder assembly of claim 2, wherein the main body defines a plurality of channels;

wherein each of the plurality of channels is fluidly connected at both ends to respective pairs of the second chambers;

wherein second chambers are linked in a chain by the plurality of channels;

wherein a first end of the chain is disposed in a forefoot region of the bladder assembly; and wherein a second end of the chain is disposed in a rearfoot region of the bladder assembly.

4. The bladder assembly of claim 1, wherein the viscous fluid includes at least one of a gel or a clay.

5. The bladder assembly of claim 1, wherein the fabric member includes a first fabric layer and a second fabric layer and a plurality of connecting filaments connected to and extending between the first and second fabric layers, wherein the gas is contained within the second chamber and places the plurality of connecting filaments in tension, the plurality of connecting filaments limiting movement of the first and second fabric layers away from each other to maintain at least a portion of the second chamber in a substantially flat state.

6. The bladder assembly of claim 1, wherein the first and second sheets are welded together at the peripheral seal; and wherein the first and second sheets are welded together at the internal seal.

7. The bladder assembly of claim 1, wherein the fabric member has a shape defining a diameter and a thickness of the fabric member, wherein the thickness is less than the diameter.

8. The bladder assembly of claim 1, wherein the viscous fluid is contained and sealed within the first chamber; and wherein the gas is contained and sealed within the second chamber.

9. The bladder assembly of claim 1, wherein the second chamber has a chamber volume, and wherein the fabric member has a periphery that defines a peripheral volume of the fabric member, the peripheral volume occupying a majority of the chamber volume.

10. An article of footwear comprising:

an upper; and a sole assembly that is operably coupled to the upper, the sole assembly including a bladder assembly, the bladder assembly including:

a main body that defines a first chamber, the main body having a peripheral seal extending continuously around a periphery of the entire main body, a plurality of second chambers, an internal seal that separates the first chamber from the second chambers, the internal seal extending continuously along the main body and a channel that provides fluid communication between the plurality of second chambers, the internal seal preventing fluid flow between the first chamber and the second chambers, the second chambers including a first inner surface and a second inner surface;

a viscous fluid contained in one of the first chamber and the plurality of second chambers;

a gas contained in the other of the first chamber and the plurality of second chambers; and a fabric member that is fixed to both the first and second inner surfaces, the fabric member limiting movement of the first and second inner surfaces away from each other wherein the internal seal is surrounded by the peripheral seal; and wherein the internal seal is spaced apart from the peripheral seal.

11. The article of footwear of claim 10, wherein the viscous fluid is contained and sealed within the first chamber; and wherein the gas is contained and sealed within the plurality of second chambers.

12. The article of footwear of claim 10, wherein the plurality of second chambers is surrounded by the peripheral seal, and wherein the first chamber is defined between the peripheral seal and the internal seal.

13. The article of footwear of claim 10, wherein the viscous fluid includes at least one of a gel or a flowable clay.

14. The article of footwear of claim 10, wherein the fabric member includes a first fabric layer and a second fabric layer and a plurality of connecting filaments connected to and extending between the first and second fabric layers, wherein the gas is contained within the plurality of second chambers and places the plurality of connecting filaments in tension, the plurality of connecting filaments limiting movement of the first and second fabric layers away from each other to maintain at least a portion of the second chamber substantially flat.

15. The article of footwear of claim 14, wherein the main body includes a first sheet and a second sheet that are coupled together at the internal seal to define the plurality of second chambers, the first fabric layer being fixed to the first sheet, and the second fabric layer being fixed to the second sheet.

16. The article of footwear of claim 10, wherein the fabric member has a shape defining a diameter and a thickness of the fabric member, wherein the thickness is less than the diameter.

17. The article of footwear of claim 10, wherein the main body includes a first sheet and a second sheet, the first and second sheets overlapping each other, wherein the first and second sheets are directly attached at a peripheral seal;

wherein the first and second sheets are directly attached at the internal seal;

wherein the first sheet, the second sheet, the peripheral seal, and the internal seal cooperate to define the first chamber; and wherein the first sheet, the second sheet, and the internal seal cooperate to define the plurality of second chambers and the channel.

18. The article of footwear of claim 10, wherein the main body includes a forefoot region, a rearfoot region, and a midfoot region between the forefoot and rearfoot regions, the first chamber extending across each of the forefoot, rearfoot, and midfoot regions, wherein at least one of the plurality of second chambers is disposed in the forefoot region, wherein at least one of the plurality of second chambers is disposed in the rearfoot region, and wherein at least one of the plurality of second chambers is disposed in the midfoot region.

19. The article of footwear of claim 10, wherein the second chamber has a chamber volume, and wherein the fabric member has a periphery that defines a peripheral volume of the fabric member, the peripheral volume occupying a majority of the chamber volume.

20. An article of footwear comprising:

an upper;

an outsole;

a midsole assembly operably coupled to both the upper and the outsole, the midsole including a bladder assembly, the bladder assembly including:

a first sheet and a second sheet, the first and second sheets overlapping each other and sealed directly together at a peripheral seal to define a first chamber, the peripheral seal extending continuously around the entire bladder, the first and second sheets additionally sealed directly at an internal seal, wherein the internal seal extends continuously along the first and second sheets, wherein the internal seal is surrounded by the peripheral seal and is spaced apart from the peripheral seal, wherein the internal seal defines a plurality of second chambers and a plurality of channels that fluidly connect respective ones of the second chambers, wherein the internal seal prevents fluid flow between the first chamber and the second chambers;

a viscous fluid contained within the first chamber, the viscous fluid including at least one of a gel or a flowable clay;

a gas contained within each of the plurality of second chambers and the plurality of channels; and a plurality of compressible fabric members, each contained within respective ones of the second chambers, and each including a first fabric layer and a second fabric layer and a plurality of connecting filaments extending between the first and second fabric layers, the first fabric layer fixed to the first sheet, the second fabric layer fixed to the second sheet, the plurality of connecting filaments limiting movement of the respective first and second fabric layers away from each other to maintain at least a portion of the respective second chamber substantially flat.

* * * * *